United States Patent [19]

Hensley

[11] 4,207,699

[45] Jun. 17, 1980

[54] GUN REST CONSTRUCTION

[76] Inventor: Wayne A. Hensley, 7990 Pittsburgh Rd., North Canton, Ohio 44720

[21] Appl. No.: 964,731

[22] Filed: Nov. 29, 1978

[51] Int. Cl.[2] ..... F41C 29/00

[52] U.S. Cl. ..... 42/94

[58] Field of Search ..... 42/94

[56] References Cited

U.S. PATENT DOCUMENTS

| | | | |
|---|---|---|---|
| 3,012,350 | 12/1961 | Wold | 42/94 |
| 3,041,938 | 7/1962 | Seabrook | 42/94 |
| 3,608,225 | 9/1971 | Manuel | 42/94 |
| 3,935,657 | 2/1975 | Wade | 42/94 |
| 3,947,988 | 4/1976 | Besaw | 42/94 |
| 4,026,057 | 5/1977 | Cady | 42/94 |
| 4,055,017 | 10/1977 | Thompson | 42/94 |

*Primary Examiner*—Charles T. Jordan
*Attorney, Agent, or Firm*—Frease & Bishop

[57] ABSTRACT

A rest which provides an extremely simple, inexpensive, rugged, and durable structure for firmly supporting the barrel of a pistol or rifle during firing. A base having a plurality of legs, one of which is adjustable, is adapted to be supported in a generally horizontal position on a surface by the legs. An L-shaped pedestal is mounted on the top surface of the base and has a threaded opening formed in a cantilever portion of the pedestal for adjustably receiving a threaded shaft therein. A V-shaped gun barrel support member is rotatably mounted on the top of the shaft by a plurality of rubber O-rings. The support member includes a cylindrical bushing frictionally engaged with the O-rings and a V-shaped bracket covered with a protective material mounted on the top of the bushing. A resilient pad of material is mounted on and extends along the rear portion of the base on which a shooter's hand and forearm is supported when firing a pistol supported by the rest.

5 Claims, 5 Drawing Figures

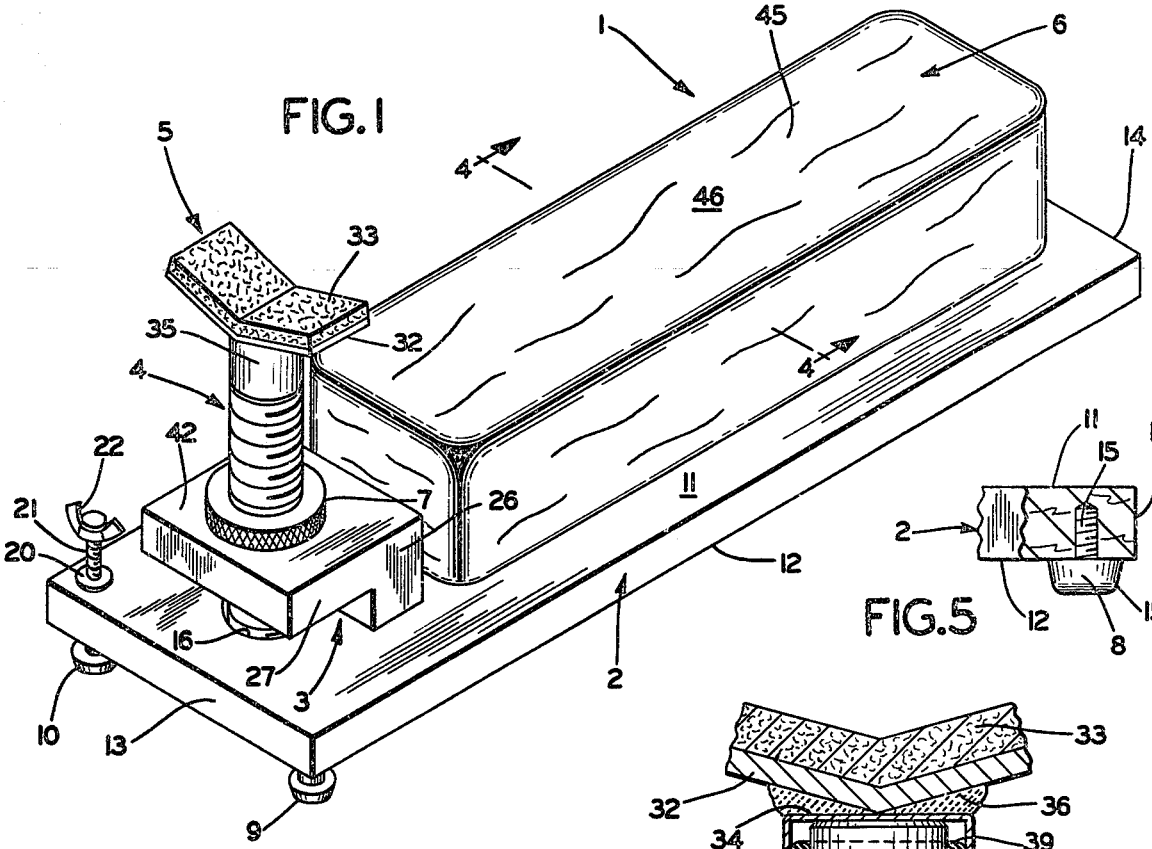
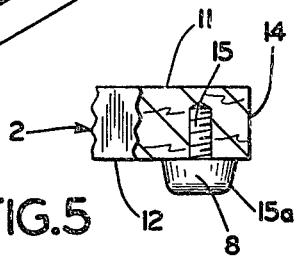
FIG. 5
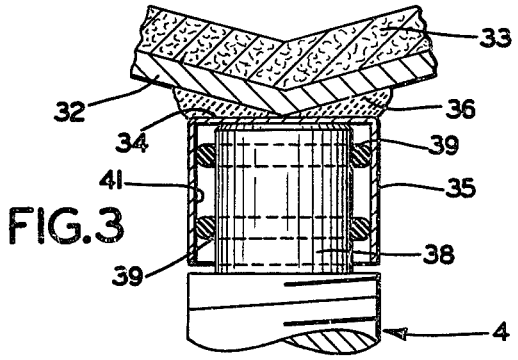
FIG. 3
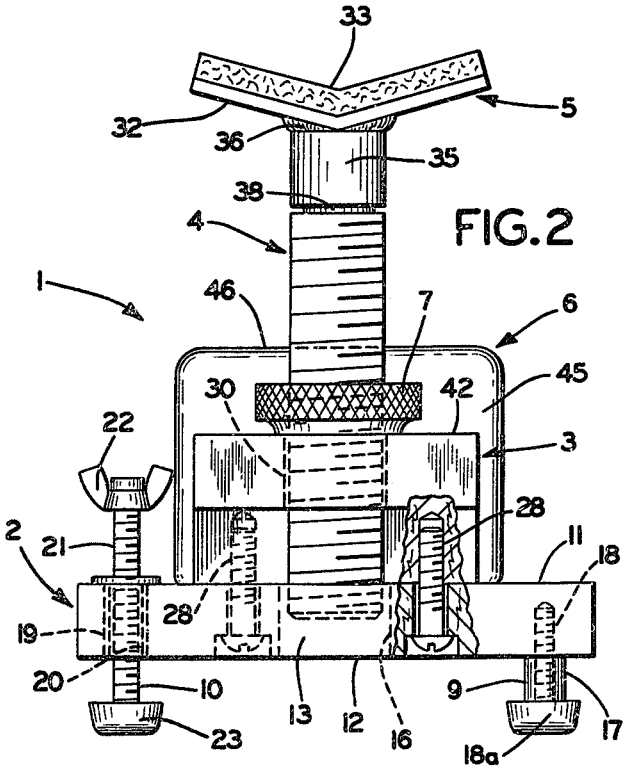
FIG. 2
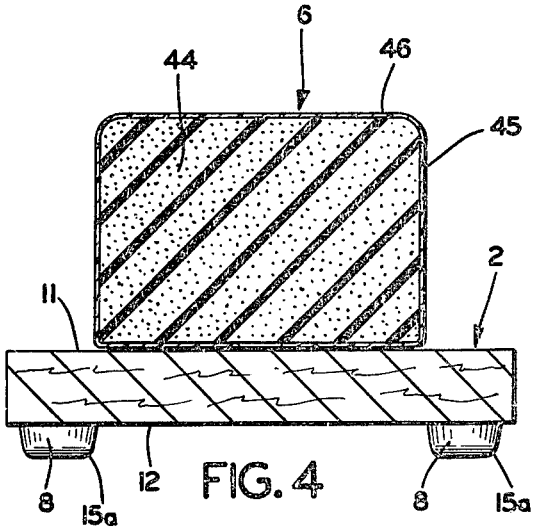
FIG. 4

GUN REST CONSTRUCTION

BACKGROUND OF THE INVENTION

1. Field of the Invention

The invention relates to firearm accessories and particularly to a rest for supporting firearms during shooting to provide a steady rest and support for the gun. More particularly, the invention relates to a rest for supporting a pistol which is of an extremely inexpensive, simple and rugged construction.

2. Description of the Prior Art

Various devices have been constructed and used to assist a shooter while firing small arms, such as rifles and pistols to provide a solid, steady rest for supporting the gun. These rests support the gun barrel while target shooting to increase accuracy, or to enable the gun sights to be adjusted, or to determine the shooting characteristics of the weapon. These devices preferably are provided with means to adjust the height of the barrel supporting element to enable the device to be used for various weapons.

Some examples of such prior art gun supports or rests are shown in U.S. Pat. Nos. 3,012,350, 3,608,225 and 4,055,017. These known devices, especially those shown in U.S. Pat. Nos. 3,012,350 and 4,055,017 appear to provide the desired results, but are relatively expensive to manufacture and produce due to their particular construction and the elements used therein. Many of the elements of these types of gun rests require expensive machining procedures for their production and assembly.

The construction such as shown in U.S. Pat No. 3,608,225 provides a gun rest which would be considerably less expensive to manufacture than the two devices described above, but would not provide as rigid a structure as these two devices. Likewise, difficulties could be encountered in properly leveling the device of U.S. Pat. No. 3,608,225 due to the possible skewing of the movable gun barrel supporting shelf. Also, the weapon could possibly strike the upper cross brace which is needed for rigidity if it experiences sufficient recoil.

Most of these devices are intended primarily for rifles as opposed to pistols, and accordingly, do not provide a convenient and comfortable rest for the hand and arm of the shooter when used with a pistol. Thus, if the rest is used for long periods of time for pistol shooting as at a target range, this could affect the shooter's accuracy.

No known gun rest construction of which I am aware provides an extremely simple and inexpensive device for firmly supporting the gun barrel in an adjustable position while providing a comfortable support for the pistol shooter's hand and arm.

SUMMARY OF THE INVENTION

Objectives of the invention include providing a gun rest construction of an extremely simple, rugged and inexpensive configuration, formed of a relatively few movable components, all of which can be produced and assembled more conveniently and inexpensively than known prior gun rests, and which provides comfort to the shooter, thereby increasing accuracy; providing such a gun rest having a vertically adjustable barrel support pedestal and additional means of adjusting the rest itself with respect to the surface on which it is supported; providing such a gun rest which has a resilient pad mounted on and extending along a majority of the gun rest base which comfortably supports the shooter's hand and forearm while firing a pistol, the barrel of which is firmly supported in the adjustable front pedestal, and in which the base is adjustable by a single leveling leg; providing such a gun rest which is fabricated of a relatively few movable components, thereby reducing maintenance and repair problems, and in which these components can be replaced inexpensively if damaged; and providing a gun rest construction which is of a lightweight, durable construction, easily transported to the shooting site, which eliminates difficulties heretofore encountered, achieves the stated objectives simply, inexpensively and effectively, and which solves problems and satisfies needs existing in the art.

These objectives and advantages are obtained by the improved gun rest construction, the general nature of which may be stated as including a generally horizontal base having top and bottom surfaces; a plurality of legs mounted on the base and projecting downwardly from the bottom surface for supporting said base, with one of said legs being adjustable; a pedestal mounted on the base adjacent the front end thereof and projecting upwardly from the top surface thereof; a vertically extending threaded opening formed in the pedestal; a threaded shaft adjustably mounted in the pedestal opening; a V-shaped gun barrel support rotatably mounted on the top of the threaded shaft; and a resilient support pad mounted on the top surface of the base and extending rearwardly from a position adjacent the pedestal toward the rear end of said base for comfortably supporting the arm and hand of a shooter.

BRIEF DESCRIPTION OF THE DRAWING

A preferred embodiment of the invention—illustrative of the best mode in which applicant has contemplated applying the principle—is set forth in the following description and shown in the accompanying drawing, and is particularly and distinctly pointed out and set forth in the appended claims.

FIG. 1 is a perspective view of the improved gun rest construction;

FIG. 2 is an enlarged front elevational view of the gun rest construction of FIG. 1, with portions broken away and in section;

FIG. 3 is a further enlarged fragmentary view, portions of which are in section, of the gun barrel support member;

FIG. 4 is an enlarged fragmentary sectional view taken on line 4—4, FIG. 1; and

FIG. 5 is an enlarged fragmentary view, portions of which are broken away and in section, of one of the base rear mountings legs.

Similar numerals refer to similar parts throughout the drawings.

BRIEF DESCRIPTION OF THE PREFERRED EMBODIMENT

The improved gun rest construction is indicated generally at 1, and is shown particularly in FIGS. 1 and 2. Construction 1 includes as its main components a relatively flat rigid base 2, an L-shaped pedestal 3, a threaded shaft 4, a gun barrel support 5, a resilient support pad 6, a lock nut 7, a pair of fixed base supporting rear legs 8, and a pair of base supporting front legs 9 and 10.

Base 2 is a relatively flat rectangular-shaped piece of material, such as wood or metal, having parallel top and bottom surfaces 11 and 12, and front and rear ends 13 and 14, respectively. A circular hole 16 is formed adjacent front end 13 of base 2 for receiving the lower end of threaded shaft 4 therein when gun barrel support 5 is in a relatively low adjustment position.

Rear legs 8 are mounted on the underside of base 2 at the two rear corners thereof and extend downwardly from bottom surface 12. Each leg 8 (FIG. 5) has a mounting screw 15 with a rubber foot pad 15*a*. Front leg 9 is generally similar to, but longer than, rear legs 8 and has a spacer sleeve 17, a mounting screw 18 and a foot pad 18*a*. When mounted on a relatively level surface, base 2 will slope rearwardly due to the greater height of front leg 9 with respect to rear legs 8. The fourth corner of base 2 is formed with a vertically extending hole 19 having a threaded sleeve 20 telescopically seated therein for adjustably receiving a threaded shank 21 of a wing bolt 22, which forms adjustable leg 10. A rubber foot pad 23 is mounted on the lower end of adjustable leg 10 and together with foot pads 15*a* and 18*a* provide nonmarring, relatively skid-proof surfaces for supporting gun rest 1.

Pedestal 3 is formed preferably of an integral L-shaped rigid piece of material, such as wood or metal. Pedestal 3 has a vertically extending portion 26 and a horizontally extending portion 27 which provide the L-shaped configuration thereto. Pedestal 3 is mounted on top base surface 11 by a pair of cap screws 28 (FIG. 2) which extend through base 2 and into vertical portion 26. Horizontal portion 27 projects forwardly from vertical portion 26 and is provided with a threaded opening 30 which is vertically aligned with hole 16 formed in base 2.

Threaded shaft 4 is adjustably mounted and engaged in pedestal opening 30 and extends vertically upwardly from base 2 and pedestal horizontal portion 27. Gun barrel support member 5 is rotatably mounted on the upper end of shaft 4.

Gun barrel support member 5 is shown particularly in FIGS. 2 and 3 and includes a V-shaped strip of rigid material 32 having a protective strip of felt material 33 mounted thereon to protect the barrel of a gun which is supported thereby. Strip 32 is attached to the top wall 34 of a cup-shaped, thin-walled bushing 35 by welds 36 or other attachment means (FIG. 3). Bushing 35 in turn is telescopically mounted on a reduced cylindrical top end 38 of threaded shaft 4. A pair of rubber O-rings 39 are telescopically mounted on shaft end 38 and frictionally engage the inner surface of cylindrical wall 41 of bushing 35 to maintain gun barrel support member 5 in an adjusted position thereon. The rubber material of O-rings 39 provides sufficient friction with respect to bushing wall 41 to enable support member 5 to be rotated relatively easily on shaft 4 to a selected position, yet will maintain member 5 in the selected adjusted position. Likewise, support member 5 can be removed easily from the top of shaft 4 during transportation of gun rest 1 or for replacing either of the components should they become damaged without requiring the use of any tools.

Lock nut 7 is adjustably mounted on shaft 4 and is adapted to engage top surface 42 of horizontal bracket portion 27 to lock shaft 4 in an adjusted position.

In accordance with another of the features of the invention, resilient pad 6 is mounted on top base surface 11 and extends from a position generally adjacent pedestal 3 rearwardly to a position adjacent base rear end 14. Pad 6 has a generally elongated block-like configuration and preferably is formed of a resilient block of material 44, (FIG. 4), such as foam rubber, and is covered with a protective covering 45 formed of leather, plastic, etc. Pad 6 is attached to top base surface 11 by an adhesive or other type of attachment means.

A shooter, when using gun rest 1, will place it on a supporting surface or ground depending upon the type of target shooting being done, and by adjusting leg 10, will compensate for any unevenness of the supporting surface. The shooter will lay his or her hand and forearm on top surface 46 of pad 6 and by rotating shaft 4 (after loosening lock nut 7) will raise or lower barrel support member 5 to the desired position while the gun barrel is supported in the valley of V-shaped strip 32.

One of the features of the invention is that shaft 4 can be adjusted vertically while the gun barrel is in position on support 5 since bushing 35 and attached support 5 will remain stationary while shaft 4 is rotatably adjusted. Lock nut 7 then is tightened against surface 42 of pedestal 3 securing shaft 4 in the adjusted position. Pad 6 is of a sufficient height enabling the shooter's hand and arm to rest comfortably along base 2 while the pistol barrel is supported by V-shaped support member 5. Another feature of the invention is that the forwardmost hand of a shooter, when using gun rest 1 with a rifle, will be supported by pad 6 providing greater comfort and ease to the shooter than other known rifle rest constructions.

Another of the main features of the invention is the relative simplicity of the device with respect to prior gun rests in that the present invention consists of a relatively few movable components which are readily available and which may be formed of inexpensive wood or metal. All of these components can be readily replaced should they become damaged or lost. Pad 6 also permits a shooter, whether using a pistol or rifle, to be more comfortable than with prior gun rests, thereby improving the shooter's accuracy and adding to his enjoyment.

Accordingly, the improved gun rest provides a construction which is effective, safe, inexpensive, lightweight, rugged, and durable in use, efficient in assembly and operation, and which achieves all the enumerated objectives, provides for eliminating difficulties encountered with prior gun rests and solves problems and obtains new results in the art.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved gun rest is constructed, assembled and operated, the characteristics of the new construction, and the advantageous, new and useful results obtained; the new and useful structures, devices, elements, arrangements, parts, and combinations are set forth in the appended claims.

I claim:

1. A gun rest construction including:

(a) a generally horizontal rigid base having top and bottom surfaces, and front and rear ends;

(b) a plurality of legs mounted on the base and projecting downwardly from the bottom surface for supporting said base;

(c) a pedestal mounted on the base adjacent the front end and projecting upwardly from the top surface of said base;

(d) a vertically extending threaded opening formed in the pedestal;

(e) a threaded shaft adjustably mounted in the pedestal opening;

(f) a gun barrel support member rotatably mounted on the top of the threaded shaft; and (g) a resilient support pad mounted on the top surface of the base and extending rearwardly from a position adjacent the pedestal toward the rear end of said base for comfortably supporting the forearm and hand of a shooter.

2. The construction defined in claim 1 in which the gun barrel support member includes a protective covered V-shaped bracket mounted on a tubular sleeve; in which O-ring means is mounted on the top of the threaded shaft; and in which the sleeve is telescopically mounted on the top of the threaded shaft and in sliding rotational engagement with the O-ring means which frictionally retain the sleeve and support member in an adjusted position.

3. The construction defined in claim 1 in which a lock nut is mounted on the threaded shaft and is adapted to engage the pedestal for retaining the shaft in an adjusted position.

4. The construction defined in claim 1 in which one of the base mounting legs is adjustable; in which the adjustable leg is a wing bolt mounted in and extending through a threaded hole formed in the base adjacent the front end thereof; and in which a rubber pad is mounted on the lower end of the wing bolt.

5. The construction defined in claim 1 in which the pedestal is an L-shaped member having a vertically extending portion attached to the top surface of the base and a horizontally forwardly extending portion spaced above said base; and in which the threaded pedestal opening is formed in the horizontal portion of the L-shaped member.

* * * * *